US010689744B2

(12) United States Patent
Wiberg et al.

(10) Patent No.: US 10,689,744 B2
(45) Date of Patent: Jun. 23, 2020

(54) METHOD AND ARRANGEMENT FOR PROCESSING ARTICLES

(71) Applicant: Quintus Technologies AB, Vasteras (SE)

(72) Inventors: Soren Wiberg, Ekero (SE); Artur Miedzinski, Mjohult (SE); Carl Silverhult, Vasteras (SE); Anders Flodin, Fleninge (SE); Dag Danielsson, Vasteras (SE); Magnus Ahlfors, Vasteras (SE); Stefan Sehlstedt, Vasteras (SE)

(73) Assignee: Quintus Technologies AB, Vasteras (SE)

( * ) Notice: Subject to any disclaimer, the term of this patent is extended or adjusted under 35 U.S.C. 154(b) by 224 days.

(21) Appl. No.: 15/559,993

(22) PCT Filed: Mar. 24, 2015

(86) PCT No.: PCT/EP2015/056269
§ 371 (c)(1),
(2) Date: Sep. 20, 2017

(87) PCT Pub. No.: WO2016/150490
PCT Pub. Date: Sep. 29, 2016

(65) Prior Publication Data

US 2018/0066350 A1 Mar. 8, 2018

(51) Int. Cl.

| | |
|---|---|
| ***C23C 8/02*** | (2006.01) |
| ***C23C 8/22*** | (2006.01) |
| ***C23C 8/80*** | (2006.01) |
| ***B30B 11/00*** | (2006.01) |
| ***C21D 1/06*** | (2006.01) |
| ***C21D 1/18*** | (2006.01) |
| ***C21D 1/74*** | (2006.01) |
| *C21D 1/76* | (2006.01) |

(52) U.S. Cl.
CPC ..... *C23C 8/02* (2013.01); *B30B 11/002* (2013.01); *C21D 1/06* (2013.01); *C21D 1/18* (2013.01); *C21D 1/74* (2013.01); *C23C 8/22* (2013.01); *C23C 8/80* (2013.01); *C21D 1/76* (2013.01)

(58) Field of Classification Search
CPC .... C23C 8/02; C23C 8/22; C23C 8/80; C21D 1/06; C21D 1/18; C21D 1/74; B30B 11/002
See application file for complete search history.

(56) References Cited

U.S. PATENT DOCUMENTS

| | | | | |
|---|---|---|---|---|
| 2004/0187966 | A1* | 9/2004 | Yamaguchi | C23C 8/20 148/223 |
| 2007/0069433 | A1* | 3/2007 | Jones | C21D 1/06 266/252 |
| 2009/0098004 | A1 | 4/2009 | Gardin | |
| 2011/0036462 | A1 | 2/2011 | Berlier et al. | |
| 2012/0251377 | A1 | 10/2012 | Hwang et al. | |

FOREIGN PATENT DOCUMENTS

| | | | |
|---|---|---|---|
| CN | 101257990 | A | 9/2008 |
| CN | 103934642 | A | 7/2014 |
| CN | 104043836 | A | 9/2014 |
| JP | S51124610 | A | 10/1976 |
| JP | S60106958 | A | 6/1985 |
| JP | H03-095886 | A | 4/1991 |
| JP | H03-130302 | A | 6/1991 |
| WO | WO-2007016930 | A1 | 2/2007 |

OTHER PUBLICATIONS

European Office Action dated May 22, 2019 for corresonding European Application No. 15713156.6.
Japanese Office Action for corresponding Japanese Application No. 2017-549678 dated Jan. 22, 2019 (with English Translation).
International Search Report PCT/ISA/210 for International Application No. PCT/EP2015/056269 dated Dec. 7, 2015.
Written Opinion of the International Searching Authority PCT/ISA/237 for International Application No. PCT/EP2015/056269 dated Dec. 7, 2015.
Written Opinion of the International Preliminary Examining Authority PCT/EP2015/056269 dated Mar. 22, 2017.
Chinese Office Action dated Mar. 7, 2019 issued in corresponding Chinese Application No. 201580078081X.

* cited by examiner

*Primary Examiner* — Jessee R Roe
(74) *Attorney, Agent, or Firm* — Harness, Dickey & Pierce, P.L.C.

(57) ABSTRACT

A method (100) for pressing at least one article in an arrangement as well as a pressing arrangement (500). The method comprises providing an article inside a load compartment and feeding a pressure medium into the pressure vessel and increasing (140) the pressure in the load compartment; increasing (120) the temperature and maintaining (150) the increased temperature and the increased pressure for selected periods of time ($t_1$, $t_2$); changing (170) the temperature from the first predetermined temperature level to a second predetermined temperature level ($T_2$); feeding (180) a carbon-containing gas into the pressure vessel; maintaining (190) the second predetermined temperature level for a selected period of time ($t_3$); reducing (200) the temperature in the load compartment; and discharging (210) the pressure medium from the pressure vessel and reducing (220) the pressure in the load compartment.

12 Claims, 3 Drawing Sheets

METHOD AND ARRANGEMENT FOR PROCESSING ARTICLES

CROSS-REFERENCE TO RELATED APPLICATIONS

This is a National Phase of PCT Patent Application No. PCT/EP2015/056269, filed on Mar. 24, 2015, the content of which is hereby incorporated by reference in the entirety.

FIELD OF THE INVENTION

The present invention relates to the field of processing of articles and/or products for improving the material properties of the articles and/or products.

BACKGROUND OF THE INVENTION

Surface hardening is a process that is used to improve the wear resistance of articles and/or products, without affecting the softer, tougher interior of the articles. It will be appreciated that the combination of a hard surface and a resistance to cracking upon impact is extremely useful in articles, products and/or components such as cam or ring gears, bearings or shafts, turbine and/or automotive components, etc., as a very hard surface to resist wear in combination with a tough interior to resist the impacts that may occur during operation is often desirable for these kind of articles or components. Generally, a surface treatment of an article may result in compressive residual stresses at the article's surface that may reduce the probability of a crack initiation and arrest crack propagation at the case-core interface. Furthermore, surface hardening of steel may be advantageous over methods such as through hardening, because less expensive low-carbon and medium carbon steels can be surface hardened with minimal problems of distortion and cracking associated with through hardening of relatively thick sections.

Surface hardening may be achieved by means of diffusion methods, whereby the chemical composition of the surface may be modified with hardening elements such as carbon (C), nitrogen (N) or boron (B). Diffusion methods are beneficial in that they may provide an effective hardening of the entire surface of the articles to be processed.

Carburizing is the addition of carbon to the surface of a low-carbon steel at T=850-980° C., at which temperature austenite (face-centered cubic structure, FCC) is the stable crystal structure. Hardening is accomplished when the steel surface is quenched such that martensite (body-centered tetragonal structure, BCT) is formed.

In gas carburizing, the articles to be processed are surrounded by an atmosphere containing carbon. However, a problem related to this technique is that the composition of the atmosphere must be closely controlled to avoid deleterious side effects such as surface and grain-boundary oxides. In efforts to simplify the atmosphere, carburizing may instead be performed at very low pressures (vacuum carburizing). However, as the flow rate of the gas may be relatively low due to the low pressure, the carbon potential of the gas may be quickly depleted due to deep recesses and blind holes of the article material. This may result in a non-uniformity in case depth over the surface of the article. On the other hand, if the gas pressure is increased in order to overcome this problem, the problem of free-carbon formation (i.e. sooting) may arise. To obtain a reasonably uniform depth, the gas pressure must be increased periodically to replenish the depleted atmosphere, and then reduced again to avoid sooting, resulting in a highly complicated operation.

Hence, there is a wish for an alternative method which is able to provide a more convenient wear-resistance treatment of articles, products and/or objects, and which furthermore may be more cost-effective and/or time-effective.

SUMMARY OF THE INVENTION

It is an object of the present invention to mitigate the above problems and to provide a method, as well as an arrangement, which achieves a convenient, cost-effective and/or time-effective treatment of articles, products and/or objects to improve their resistance to wear and/or impacts.

This and other objects are achieved by providing a method and a pressing arrangement having the features defined in the independent claims. Preferred embodiments are defined in the dependent claims.

Hence, according to a first aspect of the present invention, there is provided a method for pressing at least one article in an arrangement comprising a pressure vessel, a furnace chamber provided inside the pressure vessel, and a load compartment arranged inside the furnace chamber. The method comprises the step of providing at least one article to be processed inside the load compartment. The method further comprises the step of feeding a pressure medium into the pressure vessel and increasing the pressure in the load compartment. The method further comprises the step of increasing the temperature in the load compartment. The method further comprises the step of maintaining the increased temperature at a first predetermined temperature level for a selected period of time. The method further comprises the step of maintaining the increased pressure at a first predetermined pressure level for a selected period of time. The method further comprises the step of changing the temperature from the first predetermined temperature level to a second predetermined temperature level. The method further comprises the step of feeding a carbon-containing gas into the pressure vessel. The method further comprises the step of maintaining the second predetermined temperature level for a selected period of time. The method further comprises the step of reducing the temperature in the load compartment. Furthermore, the method comprises the step of discharging the pressure medium from the pressure vessel and reducing the pressure in the load compartment.

According to a second aspect of the present invention, there is provided a pressing arrangement. The arrangement comprises a pressure vessel, a furnace chamber provided inside the pressure vessel, and a load compartment arranged inside the furnace chamber. The arrangement further comprises a pressure medium feeding device for feeding pressure medium into the pressure vessel, and a gas feeding device for feeding gas into the pressure vessel. The pressing arrangement is configured to receive at least one article to be processed inside the load compartment. The arrangement is further configured to feed a pressure medium into the pressure vessel and increase the pressure in the load compartment. The arrangement is further configured to increase the temperature in the load compartment. Furthermore, the arrangement is configured to maintain the increased temperature at a first predetermined temperature level for a selected period of time, and to maintain the increased pressure at a first predetermined pressure level for a selected period of time. The arrangement is further configured to change the temperature from the first predetermined temperature level to a second predetermined temperature level, to feed a carbon-containing gas into the pressure vessel, and to maintain the second predetermined temperature level for a selected period of time. Furthermore, the arrangement is further configured to reduce the temperature in the load compartment, to discharge the pressure medium from the pressure vessel, and to reduce the pressure in the load compartment.

Thus, the present invention is based on the idea of subjecting one or more articles to hot isostatic pressing within a (pressing) arrangement, and thereafter subjecting the article(s) to case hardening within the same (pressing) arrangement. In the method of the present invention, the article(s) arranged in the arrangement is (are) firstly subjected to hot isostatic pressing, performed under predetermined pressure and temperature levels during (a) selected time period(s), which results in a closing of pores within the article. In turn, this achieves a relatively high densification of the article(s), leading to an increase of the service life and/or (fatigue) strength of the processed article(s). The article(s) is (are) thereafter subjected a carbon-containing gas which is fed into the pressure vessel under predetermined pressure and temperature levels during (a) selected time period(s). This carburizing process of the method of the present invention hereby modifies the chemical composition of the surface of the article(s) as the carbon diffuses to a desired (predetermined) depth of the article material. Thereafter, the temperature in the load compartment is reduced, and the pressure medium is discharged to reduce the pressure in the load compartment. The temperature reduction (quenching, cooling) step of the present invention contributes to the formation of martensite of the high-carbon surface layer of the article(s). Consequently, the method of the present invention may perform hot isostatic pressing, carburizing and case hardening of the article(s) in the same arrangement, thereby conveniently providing article(s) comprising a wear and fatigue resistant case superimposed on a tough core. It will be appreciated that the result of the method of the present invention, namely to provide articles having a relatively hard surface to resist wear in combination with a relatively tough interior for impact resistance of the articles, is extremely useful for a wide range of applications.

An advantage of the present invention is that the method efficiently and conveniently combines a hot isostatic pressing process and a case hardening process (including a carburizing process) of one or more articles. In other words, the method according to the present invention firstly reduces the porosity of the article material such that the article(s) is (are) densified, thereby improving the mechanical properties of the article(s), and thereafter hardens the case of the article(s) for improving its (their) wear properties. Consequently, the efficient and convenient method of the present invention saves time during the processing and/or treatment of the article(s). It will be appreciated the prior art does not disclose any combination of a hot isostatic pressing and a case hardening of articles as disclosed by the present invention. Hence, any attempts to improve the material properties of articles based on prior art disclosures, comparable to the improvement of the material properties of the articles based on the method according to the present invention, lead to circumstantial and/or time-inefficient operations. In contrast, the combination of a hot isostatic pressing process and a case hardening process according to the method of the present invention leads to a convenient and efficient processing and/or treatment of articles for enhancing their material properties, which method is time effective, and consequently, also cost-effective.

The present invention is advantageous in that the hot isostatic pressing process and the case hardening process for the treatment and/or processing of one or more articles are performed in the same (pressing) arrangement. Hence, if there is a wish to process articles having the sought and/or desired material properties as a result of hot isostatic pressing and case hardening, the method of the present invention eliminates the need to first perform hot isostatic pressing of article(s) in an arrangement and thereafter remove the article(s) from the arrangement to perform case hardening of the article(s) in another device or arrangement. Thus, as the steps of the method of the present invention are performed in the same arrangement, i.e. without the need of two or more devices and/or arrangements for performing the method steps, the present invention provides a convenient, time-efficient and/or cost-efficient method for improving the material properties of the article(s).

The present invention is further advantageous in that the reduction of the temperature (i.e. the quenching or cooling) in the arrangement during the case hardening process of the article(s) may be performed at a relatively high rate in the arrangement, thereby efficiently counteracting the formation of non martensitic phases in the material of the article(s).

The present invention is further advantageous in that the relatively high pressure applied in the arrangement during the carburizing process of the case hardening process may counteract a depletion of the carbon potential of the gas due to surface irregularities of the material of the article(s). Consequently, a non-uniformity in case depth over the article surface is counteracted. Hence, the present invention is advantageous in that a relatively uniform carbon diffusion depth of the article material may be achieved, leading to a case of the article with a relatively uniform resistance to wear.

The arrangement employed by the method according to the first aspect of the present invention comprises, inter alia, a pressure vessel, a furnace chamber provided inside the pressure vessel, and a load compartment arranged inside the furnace chamber. It will be appreciated that the arrangement may comprise other components and/or parts, but that further descriptions of such components and/or parts are omitted in this context. Furthermore, it will be appreciated that the (pressing) arrangement may constitute a hot isostatic pressing arrangement.

The method comprises the step of providing at least one article to be processed inside the load compartment. In other words, one or more articles may be placed or arranged within the load compartment of the arrangement. The article material may substantially be any kind of steel, but it will be appreciated that the article material may comprise other metal(s) and/or alloy(s).

The method further comprises the step of feeding a pressure medium into the pressure vessel and increasing the pressure in the load compartment of the arrangement. By "pressure medium", it is here meant a gas or gaseous medium which may have a low chemical affinity in relation to the article(s) to be processed, such as argon (Ar).

The method further comprises the step of increasing the temperature in the load compartment holding the article(s), whereby the temperature is increased by the furnace chamber.

The method further comprises the steps of maintaining the increased temperature at a first predetermined temperature level for a selected period of time and maintaining the increased pressure at a first predetermined pressure level for a selected period of time. Here, it will be appreciated that the term "level" may be interpreted as an interval. Hence, in the present method steps, the increased temperature and pressure are controlled such that the temperature and pressure lie within a desired temperature and pressure interval, respectively. The method steps of maintaining the increased temperature and increased pressure during respective time periods result in a densification of the article material, leading to an increase of the service life and/or (fatigue) strength of the processed article(s).

The method further comprises the step of changing the temperature from the first predetermined temperature level to a second predetermined temperature level. It will be appreciated that the first and second predetermined temperature levels (intervals) may be separated (i.e. different), partially overlapping (i.e. partially different) or substantially overlapping (i.e. substantially the same). The method further comprises the step of feeding a carbon-containing gas into the pressure vessel. By "carbon-containing gas", it is here meant a gaseous medium which comprises carbon (C). The method further comprises the step of maintaining the second predetermined temperature level for a selected period of time. It will be appreciated that the steps of feeding the carbon-containing gas into the pressure vessel, in which one or more articles are arranged, and maintaining the second predetermined temperature level for a selected period of time, imply a carburizing process in which a modification of the surface of the article(s) takes place as carbon diffuses into the article material to a desired depth.

The method further comprises the step of reducing the temperature in the load compartment of the arrangement. It will be appreciated that this method step of quenching or cooling the article(s) arranged in the load compartment contributes to the formation of a martensitic structure of the surface material of the article(s), wherein the martensitic structure forms a wear and fatigue resistant case of the article(s).

Furthermore, the method comprises the step of discharging the pressure medium from the pressure vessel and reducing the pressure in the load compartment. After reducing the pressure in the load compartment, the processed article(s) may be removed from the arrangement.

According to an embodiment of the present invention, the second predetermined temperature level may be lower than the first predetermined temperature level. Hence, the method step(s) concerning carburizing, i.e. allowing carbon to diffuse to a desired depth of the article material, may be performed at a (second) temperature level which is lower than the (first) temperature level at which the densification of the article material is performed by the hot isostatic pressing process. The present embodiment is advantageous in that the optimal temperature level for controlling the carbon diffusion into the article material of the carburizing process of the case hardening process of the method may be lower than the optimal temperature level for eliminating porosities of the article material of the hot isostatic pressing process of the method.

According to an embodiment of the present invention, the reduction of the temperature in the load compartment may further comprise moving (exchanging) pressure medium having a temperature at the second predetermined temperature level from the load compartment, providing pressure medium having a temperature below the second predetermined temperature level and mixing the provided pressure medium with the moved (exchanged) pressure medium, and leading the thus obtained mixed pressure medium into the load compartment. In other words, the pressure medium at the second predetermined temperature level may be moved, discharged or exchanged from the load compartment to a space outside the load compartment where the pressure medium is mixed with a pressure medium having a lower temperature, resulting in a mixed pressure medium in the space having a temperature which is below the second predetermined temperature level. The mixed pressure medium may thereafter be led (moved) from the space outside the load compartment into the load compartment, resulting in a cooling of the load compartment and the article(s) arranged therein. In other words, the relatively warm pressure medium in the load compartment is exchanged with a relatively cool pressure medium, thereby reducing the temperature in the load compartment. The present embodiment of the method may hereby achieve a relatively fast and/or even temperature reduction of the load compartment in the arrangement. Consequently, the present embodiment achieves a relatively fast and/or even cooling of one or more articles arranged (positioned) in the load compartment of the arrangement. The present embodiment is advantageous in that the relatively fast temperature reduction in the load compartment inhibits the formation of non martensitic phases in the article material, thereby improving the case hardening process of the present method. The present embodiment is further advantageous in that the relatively fast temperature reduction in the load compartment enables an unloading of the article(s) of the arrangement after a relatively short period of time after the processing of the article(s). Consequently, the method of the present embodiment may increase the process productivity since the overall cycle time may be significantly shortened.

According to an embodiment of the present invention, the providing of the at least one article to be processed inside the load compartment may further comprise providing at least one pre-pressed article, formed from at least one powder, inside the load compartment, increasing the temperature in the load compartment, and maintaining the increased temperature at a third predetermined temperature level for a selected period of time. The present embodiment hereby concerns an initial sintering process of the article(s), which may be performed before the hot isostatic pressing process and the case hardening process of the article(s), whereby the pre-pressed article(s) formed from at least one powder is compacted by heat in the arrangement without melting the article to the point of liquefaction. The present embodiment is advantageous in that the sintering process of the embodiment of the present invention, as well as the hot isostatic pressing and the case hardening of the article(s), may be performed in the same (pressing) arrangement. Hence, the present embodiment even further increases the convenience and the time and/or cost efficiency of the processing and/or treatment of the article(s) for enhancing its (their) material properties.

According to an embodiment of the present invention, the at least one powder may be selected from the group consisting of water atomized metal powder and gas atomized metal powder. In other words, the at least one (metal) powder may comprise water atomized metal powder and/or gas atomized metal powder.

According to an embodiment of the present invention, the method may further comprise increasing the temperature in the load compartment and maintaining the increased temperature at a fourth predetermined temperature level for a selected period of time after reducing the temperature in the load compartment. The embodiment of the present invention concerns a tempering process of the article(s) after the hot isostatic pressing and the case hardening of the article(s), whereby the temperature is increased again after the temperature reduction (i.e. the quenching or cooling) in the arrangement. The present embodiment is advantageous in that it may reduce the brittleness and/or increase the toughness of the article(s) after the hot isostatic pressing and the case hardening of the article(s) according to the method of the present invention. The present embodiment is further advantageous in that the tempering process may be performed in the same arrangement as the hot isostatic pressing, the case hardening and/or sintering process, thereby even further increasing the convenience, time efficiency and/or cost efficiency of the treatment of the article(s).

According to an embodiment of the present invention, the first predetermined temperature level may be 800-1500° C., preferably 1000-1300° C., and more preferably ca. 1150° C., and the selected period of time for maintaining the first temperature level may be 0.1-6 hours, preferably 0.5-4 hours, and more preferably 1-2 hours. The present embodiment is advantageous in that the indicated temperature level and time period for the hot isostatic pressing process of the article(s) contribute to a relatively high densification of the article while still resulting in a relatively short holding time.

According to an embodiment of the present invention, the first predetermined pressure level may be 20-500 MPa, preferably 50-200 MPa, and more preferably 80-150 MPa, and the selected period of time for maintaining the first predetermined pressure level may be 0.1-8 hours, preferably 1-5 hours, and more preferably 2-3 hours. It will be appreciated that the first predetermined pressure level may be maintained during the hot isostatic pressing and the case hardening (including the carburizing) of the article(s). The present embodiment is advantageous in that the indicated pressure level contributes to a relatively high densification of the article during the hot isostatic pressing and a relatively uniform carbon diffusion depth of the article material during the case hardening, while still resulting in a relatively short holding time.

According to an embodiment of the present invention, the second predetermined temperature level may be 600-1200° C., preferably 750-1050° C., and more preferably ca. 950° C., and wherein the selected period of time for maintaining the second temperature level may be 0.1-3 hours, preferably 0.1-1.5 hours, and more preferably ca. 0.5 hour. The present embodiment is advantageous in that the indicated second predetermined temperature level and time period for the carburizing process of the case hardening of the article(s) may lead to a desired diffusion depth of the article(s).

According to an embodiment of the present invention, the reduction of the temperature in the load compartment may have a rate of 200-2000° C./min in the temperature interval of 800-500° C. in the load compartment. In other words, after the carburizing process of the method, which may be conducted at a temperature level of 600-1200° C., preferably 750-1050° C., the method may reduce the temperature relatively fast in the load compartment of the arrangement. The present embodiment is advantageous in that the relatively fast temperature reduction rate, i.e. cooling rate or quenching rate, in the indicated temperature interval counteracts the formation of non martensitic phases in the article material. This improves the formation of martensite of the article material, which consequently hardens the article.

According to an embodiment of the present invention, the fourth predetermined temperature level may be 100-400° C., preferably 150-250° C., and more preferably 180-200° C., and the selected period of time for maintaining the fourth predetermined temperature level may be 0.1-4 hours, preferably 0.5-2 hours, and more preferably ca. 1 hour. The present embodiment is advantageous in that the indicated fourth predetermined temperature level and time period during the tempering process of the article(s) may lead to a desired reduction of the brittleness and/or an increase of the toughness of the article(s) while still resulting in a relatively short holding time.

According to an embodiment of the present invention, the carbon-containing gas may be selected from the group consisting of methane ($CH_4$), acetylene ($C_2H_2$), carbon monoxide (CO) and carbon dioxide ($CO_2$). The present embodiment is advantageous in that the gases are relatively abundant and inexpensive.

It will be appreciated that the specific embodiments described above with reference to the method according to the first aspect of the present invention are likewise applicable and combinable with the pressing arrangement according to the second aspect of the present invention. Furthermore, the mentioned advantages of the method according to the first aspect of present invention also hold for the pressing arrangement according to the second aspect of the present invention. It will be appreciated that the pressing arrangement of the second aspect of the present invention is described as being "configured to" perform several steps in accordance with the method of the first aspect of the present invention. Here, the term "configured to" may alternatively be interpreted as "arranged to", "adapted to" and/or "able to", i.e. that the pressing arrangement is arranged, adapted and/or able to perform said steps.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

The present invention will now be described in more detail, with reference to the appended drawings showing embodiment(s) of the invention.

DETAILED DESCRIPTION

Figure 1:
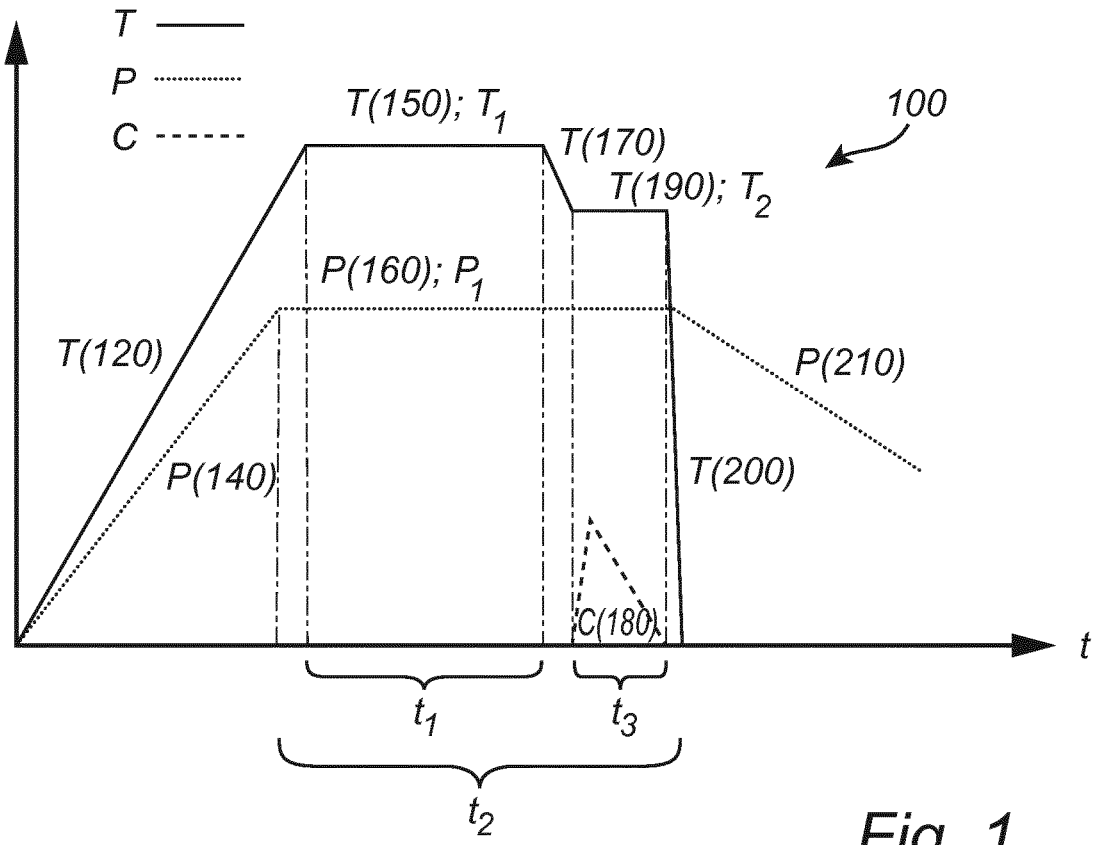
FIG. 1 is a schematic diagram of a method for processing at least one article according to an embodiment of the present invention.

FIG. 1 is a schematic diagram of a method 100 for processing at least one article in a (pressing) arrangement. The arrangement, comprising a pressure vessel, a furnace chamber provided inside the pressure vessel, and a load compartment arranged inside the furnace chamber, may constitute a hot isostatic pressing (HIP) arrangement. It will be appreciated that the ordinate (y-axis) in FIG. 1, as well as in FIGS. 3-4, only schematically indicates (levels of) temperature, pressure and/or carbon concentration, and is not to scale. Analogously, the abscissa (x-axis) in the mentioned figures only schematically indicates time, and is not to scale.

According to the method 100 of the present invention, one or more articles to be processed by the method of the present invention are provided (arranged) inside the load compartment of the arrangement. A pressure medium, e.g. argon (Ar), is fed into the pressure vessel such that the pressure P in the load compartment increases 140. The temperature T is thereafter increased 120 in the load compartment by means of the furnace chamber. It will be appreciated that the gradients of the increasing temperature T and pressure P in the load compartment are only schematically indicated.

The increased temperature T is thereafter maintained 150 at a first predetermined temperature level $T_1$ for a selected period of time $t_1$. The first predetermined temperature level $T_1$ may be 800-1500° C., preferably 1000-1300° C., and more preferably ca. 1150° C. Furthermore, the selected period of time $t_1$ for maintaining the first predetermined temperature level $T_1$ may be 0.1-6 hours, preferably 0.5-4 hours, and more preferably 1-2 hours. The increased pressure P is maintained 160 at a first predetermined pressure level $P_1$ for a selected period of time $t_2$. The first predetermined pressure level $P_1$ may be 20-500 MPa, preferably 50-200 MPa, and more preferably 80-150 MPa. Furthermore, the selected period of time $t_2$ for maintaining the first predetermined pressure level $P_1$ may be 0.1-8 hours, preferably 1-5 hours, and more preferably 2-3 hours. As an alternative, the selected period of time $t_2$ for maintaining the first predetermined pressure level $P_1$ may be approximately the same as the selected period of time $t_1$ for maintaining the first temperature level $T_1$. For example, if the first predetermined temperature level $T_1$ is decreased to the second predetermined temperature level $T_2$, the first predetermined pressure level $P_1$ may decrease as a result of this temperature reduction. It will be appreciated that the first predetermined temperature level $T_1$, the time $t_1$ for maintaining the first predetermined temperature level $T_1$, the first predetermined pressure level $P_1$ and/or the time $t_2$ for maintaining the first predetermined pressure level $P_1$ may be dependent on several factors such as the article material used.

Hence, the method 100 of the present invention maintains the temperature 150 at the first predetermined temperature level $T_1$ and maintains the pressure 160 at the first predetermined pressure level $P_1$, at least during the time $t_1$ as exemplified, whereby the article(s) in the load compartment of the (pressing) arrangement are subjected to hot isostatic pressing. In other words, the exemplified settings of the temperature and the pressure of the method achieves a relatively high densification of the article(s) arranged in the arrangement, leading to an increase of the service life and/or (fatigue) strength of the processed article(s). It will be appreciated that the first predetermined temperature level $T_1$ may be reached before, simultaneously or after the first predetermined pressure level $P_1$ has been reached.

After performing hot isostatic pressing of the article(s), the method 100 of the present invention comprises changing 170 the temperature T from the first predetermined temperature level $T_1$ to a second predetermined temperature level $T_2$. In FIG. 1, $T_2$ is indicated as being lower than $T_1$, i.e. $T_2<T_1$, but it will be appreciated that $T_2$ alternatively may be the same or higher than $T_1$, i.e. $T_2 \leq T_1$. As an example, $T_2$ may be 600-1200° C., preferably 750-1050° C., and more preferably ca. 950° C. As previously indicated, the (levels of) temperature T and/or pressure P are only schematically indicated, and are not to scale.

The method 100 of the present invention thereafter comprises feeding 180 of a carbon-containing gas into the pressure vessel of the arrangement. It will be appreciated that the carbon-containing gas may be substantially any gas comprising carbon (C), such as methane, acetylene, carbon dioxide and/or carbon monoxide. The carbon concentration C of the pressure medium within the pressure vessel is schematically indicated in FIG. 1. At first, the carbon concentration C of the pressure medium increases rapidly as the carbon-containing gas is fed 180 into the pressure vessel of the arrangement. Then, the carbon concentration C of the pressure medium decreases as carbon diffuses into the material of the article(s), modifying the chemical composition of the surface of the article(s). The process of the method 100 of the present invention hereby comprises a case hardening of the article(s), which in turn comprises an initial carburizing process of the article(s) arranged in the load compartment of the arrangement. The pressure level in the (pressing) arrangement during the carburizing process of the method may be substantially the same as during the hot isostatic pressing process, i.e. $P_1$, which may be 20-500 MPa, preferably 50-200 MPa, and more preferably 80-150 MPa, such as approximately 100 MPa. The pressure of the carbon-containing gas fed into the pressure vessel may be 10 kPa-4 MPa (0.1 bar-40 bar). It will be appreciated that the diffusion depth of carbon of the article material is dependent on several factors, such as the chemical composition of the article material, the carbon concentration C in the surrounding pressure medium, the surrounding pressure P and temperature T, the holding time, etc. Hence, the skilled person realizes that the pressure P, temperature T, carbon concentration C and/or holding time to which the article(s) is (are) subjected may be varied in the method of the present invention to achieve a desired diffusion depth of carbon of the article material. A desired concentration of carbon at the article surface may be approximately 0.8%. However, it will be appreciated that the desired carbon concentration at the article surface is dependent on several factors, such as the article material.

After the method 100 of the present invention has performed the carburizing of the article(s) in the case hardening process, the temperature T is reduced 200 in the load compartment. Hence, the temperature T is reduced from the second predetermined temperature level $T_2$ to a significantly lower temperature T, e.g. ambient temperature. It will be appreciated that the reduction 200 of the temperature T in the load compartment may be relatively fast. For example, the temperature may be decreased by a rate of 200-2000° C./min in the temperature interval of 800-500° C. in the load compartment. The relatively fast temperature reduction (quenching, cooling) step of the method 100 of the present invention contributes to the formation of martensite of the high-carbon surface layer of the article(s), thereby providing article(s) comprising a wear and fatigue resistant case.

After performing the case hardening process of the method 100 of the present invention, the pressure medium is discharged from the pressure vessel and the pressure is reduced 210 in the load compartment. Eventually, after the pressure P has reached a relatively low pressure (e.g. ambient pressure), the processed article(s) may be removed from the arrangement. Consequently, the method 100 of the present invention may perform hot isostatic pressing and case hardening (including carburizing) of article(s) in the same arrangement, thereby conveniently providing article(s) comprising a wear and fatigue resistant case superimposed on a tough core.

Figure 2:
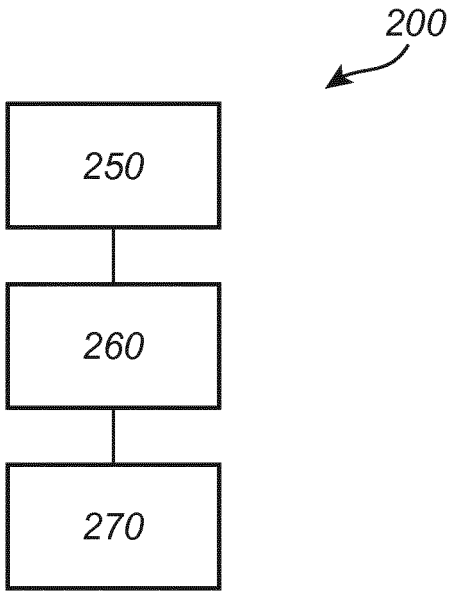
FIG. 2 is a schematic block diagram of a temperature reducing process according to an embodiment of the present invention.

FIG. 2 shows a schematic block diagram of the reduction 200 of the temperature (i.e. the quenching or cooling) shown in FIG. 1 in the load compartment of the (pressing) arrangement, in which one or more articles are arranged, according to an embodiment of the method of the present invention. The reduction 200 of the temperature comprises moving 250 pressure medium having a temperature at the second predetermined temperature level from the load compartment, e.g. to a space outside the load compartment. Then, pressure medium is provided 260 having a temperature below the second predetermined temperature level, and the provided pressure medium is mixed with the moved pressure medium. The thus obtained mixed pressure medium is thereafter led 270, e.g. from the space outside the load compartment, into the load compartment of the (pressing) arrangement. It will be appreciated that these steps of the embodiment of the method of the present invention may be repeated continuously during the cooling of the load compartment for an efficient cooling of the article(s) arranged therein.

Figure 3:
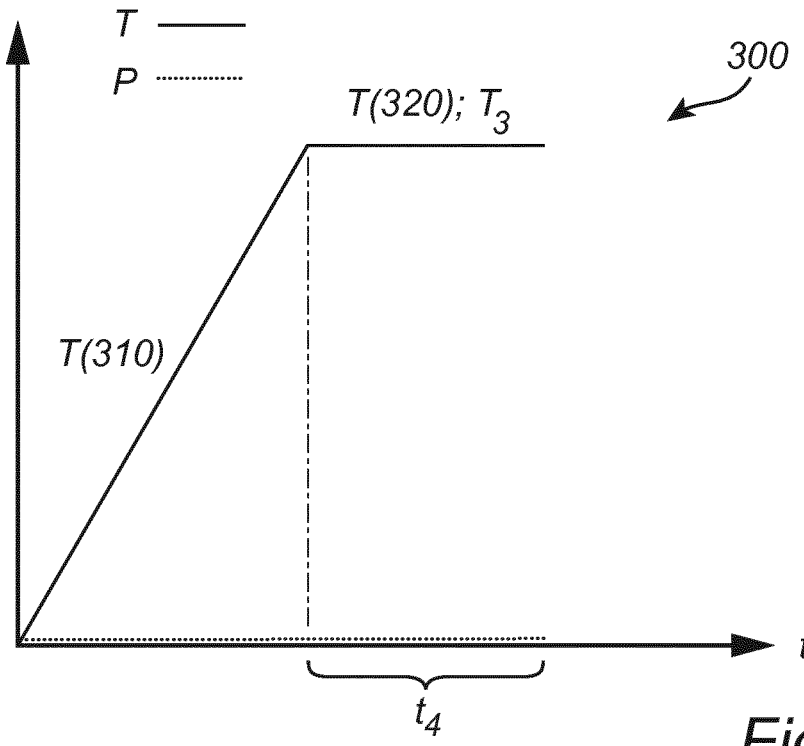
FIG. 3 is a schematic diagram of a sintering process of at least one article according to an embodiment of the present invention.

FIG. 3 is a schematic diagram of a sintering process 300 of at least one pre-pressed article according to an embodiment of the present invention. The pre-pressed article(s) to be processed in the load compartment of the (pressing) arrangement may be formed from at least one (metal) powder. For example, the at least one powder may comprise water atomized metal powder and/or gas atomized metal powder. The embodiment 300 of the method of the present invention comprises increasing 310 the temperature T in the load compartment in which the pre-pressed article(s) are arranged and maintaining 320 the increased temperature at a third predetermined temperature level $T_3$ for a selected period of time $t_4$. It will be appreciated that the pressure P during the step of maintaining the third predetermined temperature level $T_3$ for the selected period of time $t_4$ may be relatively low, e.g. ambient pressure. The third predetermined temperature level $T_3$ may, for example be 1000-1300° C., such as approximately 1150° C., and $t_4$ may, for example, be 0.5-4 h, such as approximately 1-2 h. It will be appreciated that the third predetermined temperature level $T_3$ and/or the time $t_4$ for maintaining the third predetermined temperature level $T_3$ may be dependent on several factors such as the article material used.

It will be appreciated that this sintering process 300 of the method of the present invention may take place in the same (pressing) arrangement before the hot isostatic pressing process and the case hardening process of the method of the present invention.

Figure 4:
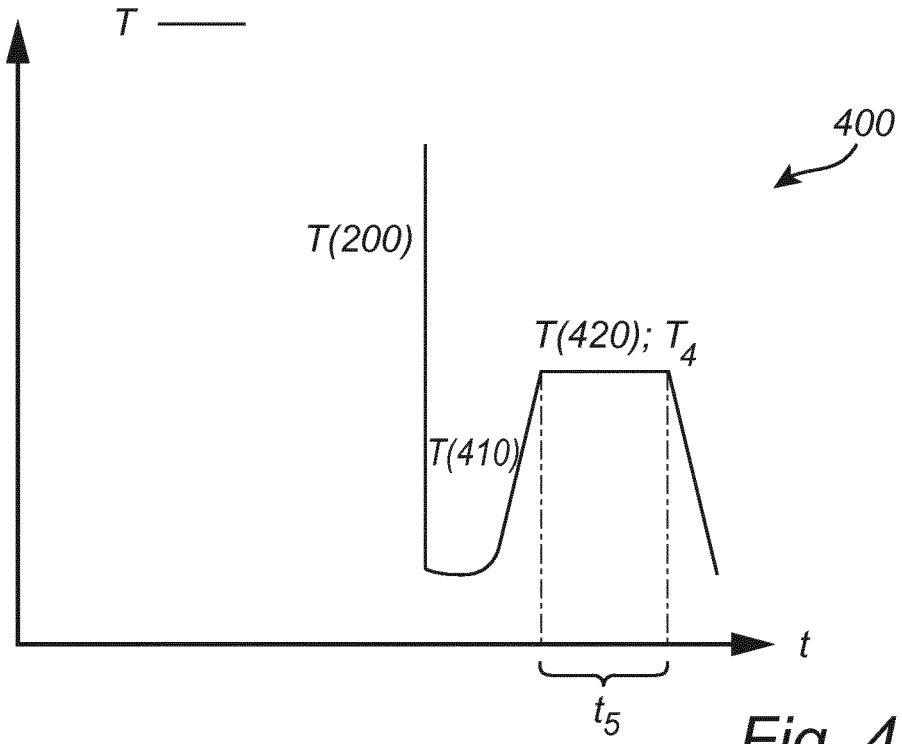
FIG. 4 is a schematic diagram of a tempering process of at least one article according to an embodiment of the present invention.

FIG. 4 is a schematic diagram of a tempering process 400 of at least one article according to an embodiment of the present invention. Here, the tempering process of the article(s) is performed after the hot isostatic pressing process and the case hardening process of the article(s) according to the method of the present invention, i.e. after the reduction 200 of the temperature according to FIG. 1. In the tempering process 400 of the method of the present invention, the temperature T in the load compartment is increased 410 and maintained 420 at a fourth predetermined temperature level $T_4$ for a selected period of time $t_5$. The fourth predetermined temperature level $T_4$ may, for example, be 100-400° C., preferably 150-250° C., and more preferably 180-200° C. Furthermore, the selected period of time $t_5$ for maintaining the fourth predetermined temperature level may be 0.1-4 hours, preferably 0.5-2 hours, and more preferably ca. 1 hour. It will be appreciated that the fourth predetermined temperature level $T_4$ and/or the time $t_5$ for maintaining the fourth predetermined temperature level $T_3$ may be dependent on several factors, e.g. the article material used.

Figure 5:
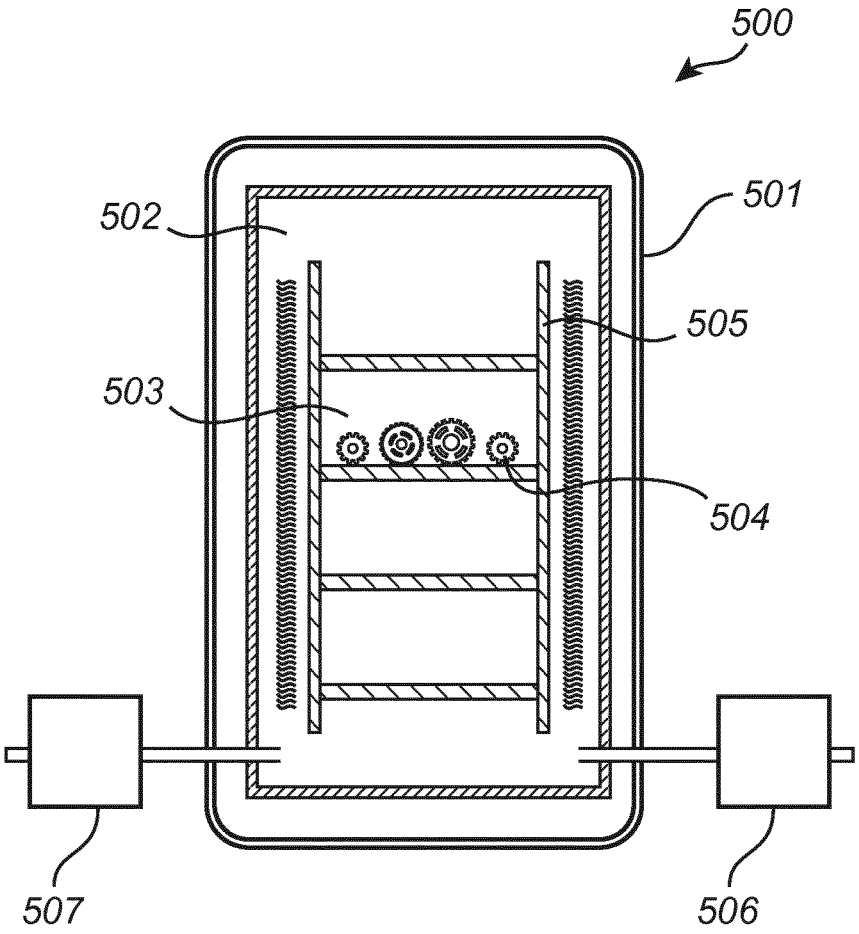
FIG. 5 is a schematic view of a pressing arrangement according to an embodiment of the second aspect of the present invention.

FIG. 5 is a schematic view of a pressing arrangement 500 according to an embodiment of the second aspect of the present invention. The pressing arrangement 500 comprises a pressure vessel 501. Although not shown in FIG. 1, the pressure vessel 501 may be opened such that the contents of the pressure vessel 501 can be removed. A furnace chamber 502 is provided inside the pressure vessel 501, and a load compartment 503 is arranged inside the furnace chamber 502 for receiving and holding one or more articles 504 to be processed. The load compartment 503 may comprise a holding arrangement 505 for holding or supporting the articles 504. It will be appreciated that the holding arrangement 505 of the load compartment 503 in FIG. 5 is only schematically indicated, and that the holding arrangement 505 may take on substantially any other form or shape for holding the articles 504, such as a cylinder shape. In FIG. 5, gear wheels constitute the example of articles 504 to be processed by the present invention. It will be appreciated that the present invention is particularly suitable for the processing of articles 504 or components such as gear wheels, as the present invention results in gear wheels having teeth cases which are wear and fatigue resistant and which are superimposed on tough teeth cores. However, the present invention may be applied to substantially any other article(s) 504 or component(s) for improving its (their) the material properties, such as cam or ring gears, bearings or shafts, etc.

The furnace chamber 502 of the pressing arrangement 500 comprises heating elements for increasing the temperature of the furnace chamber 502 and, hence, the load compartment 503 in which the article(s) 504 are arranged.

The pressing arrangement 500 further comprises a pressure medium feeding device 506, which is schematically indicated in FIG. 5, for feeding pressure medium into the pressure vessel 501 of the pressing arrangement 500. The pressure medium may, for example, be argon (Ar), but it will be appreciated that substantially any other gas or gaseous medium which has a low chemical affinity in relation to the articles to be processed may be used. The pressure medium feeding device 506 may comprise one or more compressors for increasing the pressure within the pressure vessel 501. It will be appreciated that a more detailed presentation of the pressure medium feeding device 506 is omitted, since details of such a device are known to the person skilled in the art.

The pressing arrangement 500 further comprises a gas feeding device 507 for feeding gas into the pressure vessel 501, wherein the gas feeding device 507 is schematically indicated in FIG. 5. The gas supplied to the gas feeding device 507 and fed into the pressure vessel 501 by the gas feeding device 507 may be a carbon-containing gas such as methane, acetylene, carbon dioxide, carbon monoxide, or a mixture thereof. It will be appreciated that a more detailed presentation of the gas feeding device 506 is omitted, since details of such a device are known to the person skilled in the art.

Although the pressure medium feeding device 506 and the gas feeding device 507 are shown as two separate devices in FIG. 5, it will be appreciated that the pressure medium feeding device 506 and the gas feeding device 507 may alternatively constitute a single (combined) device of the pressing arrangement 500.

It will be appreciated that the pressing arrangement 500 as presented in this context may constitute a hot isostatic press (HIP).

The pressing arrangement 500 according to the present invention is configured to receive at least one article 504 to be processed inside the load compartment 503. The pressing arrangement 500 is further configured to feed the pressure medium into the pressure vessel 501 by means of the pressure medium feeding device 506 such that the pressure in the load compartment 503 is increased. The pressing arrangement 500 is further configured to increase the temperature in the load compartment 503 by means of the furnace chamber 502. The pressing arrangement 500 is further configured to maintain the increased temperature T at a first predetermined temperature level $T_1$ for a selected period of time $t_1$ and to maintain the increased pressure P at a first predetermined pressure level $P_1$ for selected periods of time $t_1$ and $t_2$, respectively, according to the schematic diagram of FIG. 1. The pressing arrangement 500 is further configured to change the temperature T from the first predetermined temperature level $T_1$ to a second predetermined temperature level $T_2$, to feed a carbon-containing gas into the pressure vessel 501 by means of the gas feeding device 507 and to maintain the second predetermined temperature level $T_2$ for a selected period of time $t_3$, according to the schematic diagram of FIG. 1. The pressing arrangement 500 is further configured to reduce the temperature in the load compartment 503, and to discharge the pressure medium from the pressure vessel 501 such that the pressure P in the load compartment 503 is reduced.

Consequently, it will be appreciated that the pressing arrangement 500 is configured to perform hot isostatic pressing, carburizing and case hardening of article(s) in the same pressing arrangement 500, thereby conveniently providing article(s) comprising a wear and fatigue resistant case superimposed on a tough core.

Even though the invention has been described with reference to specific exemplifying embodiments thereof, many different alterations, modifications and the like will become apparent for those skilled in the art. The described embodiments are therefore not intended to limit the scope of the invention, as defined by the appended claims. For example, the diagrams of FIGS. 1, 3 and 4 for presenting the method of the present invention are merely schematically indicated, and are not to scale. Furthermore, any sizes and/or number of units, devices or the like of the schematically indicated pressing arrangement 500 in FIG. 5 according to the second aspect of the present invention may be different than those described.

The invention claimed is:

1. A method for processing at least one article in an arrangement comprising a pressure vessel, a furnace chamber provided inside the pressure vessel, and a load compartment arranged inside the furnace chamber, wherein the method comprises:

performing a hot isostatic pressing (HIP) operation, the HIP operation including providing at least one article to be processed inside the load compartment;

feeding a pressure medium into the pressure vessel via a pressure medium feeding device and increasing a pressure in the load compartment;

increasing a temperature in the load compartment;

maintaining the increased temperature at a first predetermined temperature level ($T_1$) for a selected period of time ($t_1$); and maintaining the increased pressure at a first predetermined pressure level ($P_1$) for a selected period of time ($t_2$), and performing a case hardening operation subsequent to the performing the HIP operation, the case hardening operation including changing the temperature from the first predetermined temperature level to a second predetermined temperature level ($T_2$);

feeding a carbon-containing gas into the pressure vessel via a gas feeding device that is separate from the pressure medium feeding device;

maintaining the second predetermined temperature level for a selected period of time ($t_3$);

reducing the temperature in the load compartment; and discharging the pressure medium from the pressure vessel and reducing the pressure in the load compartment.

2. The method according to claim 1, wherein the second predetermined temperature level is lower than the first predetermined temperature level.

3. The method according to claim 1, wherein the reducing of the temperature in the load compartment further comprises:

moving pressure medium having a temperature at the second predetermined temperature level from the load compartment;

providing pressure medium having a temperature below the second predetermined temperature level and mixing the provided pressure medium with the moved pressure medium to obtain a mixed pressure medium; and leading the obtained mixed pressure medium into the load compartment.

4. The method according to claim 1, wherein the providing of the at least one article to be processed inside the load compartment further comprises:

providing at least one pre-pressed article, formed from at least one powder, inside the load compartment;

increasing the temperature in the load compartment; and maintaining the increased temperature at a third predetermined temperature level ($T_3$) for a selected period of time ($t_4$).

5. The method according to claim 4, wherein the at least one powder is selected from the group consisting of water atomized metal powder and gas atomized metal powder.

6. The method according to claim 1, wherein the method further comprises:

increasing the temperature in the load compartment; and maintaining the increased temperature at a fourth predetermined temperature level ($T_4$) for a selected period of time ($t_5$) after reducing the temperature in the load compartment.

7. The method according to claim 6, wherein the fourth predetermined temperature level ($T_4$) is 100-400° C., and wherein the selected period of time ($t_5$) for maintaining the fourth predetermined temperature level is 0.1-4 hours.

8. The method according to claim 1, wherein the first predetermined temperature level ($T_1$) is 800-1500° C., and wherein the selected period of time ($t_1$) for maintaining the first predetermined temperature level is 0.1-6 hours.

9. The method according to claim 1, wherein the second predetermined temperature level ($T_2$) is 600-1200° C., and wherein the selected period of time ($t_3$) for maintaining the second predetermined temperature level is 0.1-3 hours.

10. The method according to claim 1, wherein the reducing of the temperature in the load compartment has a rate of 200-2000° C./min in a temperature interval of 800-500° C. in the load compartment.

11. The method according to claim 1, wherein the carbon-containing gas is selected from the group consisting of methane, acetylene, carbon monoxide and carbon dioxide.

12. A method for processing at least one article in an arrangement comprising a pressure vessel, a furnace chamber provided inside the pressure vessel, and a load compartment arranged inside the furnace chamber, wherein the method comprises:

performing a first operation, the first operation including providing at least one article to be processed inside the load compartment;

feeding a pressure medium into the pressure vessel via a pressure medium feeding device and increasing a pressure in the load compartment;

increasing a temperature in the load compartment;

maintaining the increased temperature at a first predetermined temperature level ($T_1$) for a selected period of time ($t_1$); and maintaining the increased pressure at a first predetermined pressure level ($P_1$) for a selected period of time ($t_2$), wherein the first predetermined pressure level ($P_1$) is 20-500 MPa, and wherein the selected period of time ($t_2$) for maintaining the first predetermined pressure level is 0.1-8 hours, and performing a second operation subsequent to the performing the first operation, the second operation including changing the temperature from the first predetermined temperature level to a second predetermined temperature level ($T_2$);

feeding a carbon-containing gas into the pressure vessel via a gas feeding device that is separate from the pressure medium feeding device;

maintaining the second predetermined temperature level for a selected period of time ($t_3$);

reducing the temperature in the load compartment; and discharging the pressure medium from the pressure vessel and reducing the pressure in the load compartment.

* * * * *